United States Patent [19]

Breault

[11] 4,095,388

[45] Jun. 20, 1978

[54] STRENGTHENING INTER-TILE ADHESION

[75] Inventor: Homer Breault, Pine Glen, Pa.

[73] Assignee: PermaGrain Products, Inc., Media, Pa.

[21] Appl. No.: 805,777

[22] Filed: Jun. 13, 1977

[51] Int. Cl.[2] ..... E04B 5/00

[52] U.S. Cl. ..... 52/747; 52/590; 156/71; 404/40

[58] Field of Search ..... 52/746, 747, 748, 390, 52/391, 392, 302, 592, 593; 404/40–42; 156/71

[56] References Cited

U.S. PATENT DOCUMENTS

| | | | |
|---|---|---|---|
| 3,988,187 | 10/1976 | Breault | 156/71 |

FOREIGN PATENT DOCUMENTS

| | | | |
|---|---|---|---|
| 1,131,533 | 2/1957 | France | 52/390 |
| 1,076,482 | 10/1954 | France | 52/390 |
| 327,841 | 4/1930 | United Kingdom | 404/41 |
| 251 of | 1892 | United Kingdom | 52/391 |

*Primary Examiner*—John E. Murtagh
*Attorney, Agent, or Firm*—Eugene E. Renz, Jr.

[57] ABSTRACT

Changes in temperature and humidity over a long period of time lead to propensities for breaking the adhesive bond between adjacent tiles when the tiles are adhered together only at underfitting-overhanding boundary zones. Propensities for such malfunctioning are minimized by providing two sizes of tiles and laying the rectangular tiles so that in both rectangular directions, the adhesive paths across the floor area are not straight lines, but have offsets and staggers so that there is no straight line of adhesion longer than the length of one and one-half large tiles.

1 Claim, 6 Drawing Figures

STRENGTHENING INTER-TILE ADHESION

FIELD OF INVENTION

This invention relates to a method of laying floor tile and to the resulting assembly of floor tiles.

PRIOR ART

Witt et al U.S. Pat. No. 3,988,187 describes a method of applying floor tiles in which, throughout a central portion of the floor, there is not any conventional adherence of tiles to the subflooring and in which there is not any conventional adhesion of vertical walls of adjacent tiles to each other to bond together all of the tiles of the central portion for use as a flooring. The system works well and represents an outstanding commercial success. However, there have been some difficulties attributable to long term effects of fluctuations of humidity and/or temperature. In floors having uniform size tiles and laid in a staggered arrangement, it was discovered that if there was a malfunction, such malfunctioning usually occurred along a path of adhesion extending essentially as a straight line across the central portion of the floor of U.S. Pat. No. 3,988,187.

Heretofore there have been artistic designs for flooring utilizing a plurality of sizes of tiles. Such arrangements of the various sized tiles merely served aesthetic purposes as distinguished from efforts to solve engineering problems. Notwithstanding the great variety of suggestions of aesthetic patterns, the flooring industry continued to be faced with problems in meeting the desiderata of simplicity of application of the floor tiles and long term troublesome free maintenance of the thus laid flooring.

SUMMARY OF THE INVENTION

In accordance with the present invention, the paths of the boundary lines on both rectangular directions are staggered and offset so that there is no straight line portion longer than about one and one-half tile lengths. By thus having adequate staggering and offsetting in both directions, the adhesion of the tiles has greater durability and better withstands the fluctuations of humidity, temperature and other variables to decrease the likelihood of the opening of any gap between tiles. Such double staggering is achieved by the use of an equal number of large and small rectangular tiles, the two dimensions of the larger tiles being each twice that of the smaller tiles, i.e. the larger tile has an area which is four times that of the smaller tile. By using the combination of an equal number of smaller tiles and larger tiles so that approximately 20% of the area is covered by the smaller tiles and about 80% by the larger tiles, and by providing the combination of larger tile and smaller tile adjacent each edge of each large tile, the desired engineering effect of double staggering of the boundary lines is achieved. In the central zone of a floor (ignoring the exceptions inherent near the walls of a room) each larger tile on each of its four boundaries is bounded to be both a larger tile and a smaller tile.

The invention concerns a method of applying floor tiles to a subflooring for an area which includes the steps of preparing a set of smaller rectangular floor tiles having a predetermined length and a predetermined width, each tile having overhanging-underfitting relationship of straight line boundary portions which in the unadhered conditions permit two adjacent tiles to be slideably adjustable with respect to each other;

preparing a set of larger rectangular floor tiles having a predetermined length substantially twice the length of said smaller tile and having a predetermined width substantially twice the width of said smaller tile, each tile having overhanging-underfitting relationship of straight line boundary portions which in the unadhered condition permits two adjacent tiles to be slideably adjustable with respect to each other;

applying floor tiles to a central portion of a subflooring, said tiles being adhered to each other only at the overhanging-underfitting zones, while retaining vent paths for the diffusion of moisture to permit the moisture content of the subflooring and the moisture content of the atmosphere to equilibrate readily in such central area because of not using conventional adhesive relationship of the floor tiles and subflooring throughout such central area, a gas permeation zone being maintained between the vertical walls of adjacent tiles, there being no adhesion between said vertical walls;

staggering the distribution of a substantially equal number of said smaller tiles and said larger tiles in said central area whereby any path of adhesion across the central portion in either of two rectangular directions has numerous offsets and staggers involving no continuous line longer than about one and one-half lengths of a larger tile, each larger tile on each of its four sides having the adhesive overhanging-underfitting bonding with a portion of at least one other larger tile and with at least a portion of a smaller tile, said staggering of the adhesion of the overlapping-underlying boundary portions without adhesion to the subflooring imparting greater resistence to buckling, separation of adjacent tiles and related long term malfunction stimulated by fluctuations of humidity and temperatutre than attained for the similar adhesion of the overlapping-underlying boundary portions of rectangular tiles of substantially uniform size when laid without adhesion to the subflooring.

The nature of the invention is further clarified by the description of some preferred embodiments.

DESCRIPTION OF PREFERRED EMBODIMENTS

Reference is made to Witt et al U.S. Pat. No. 3,988,187, all the disclosure of which is deemed here reiterated. Said Witt et al patent discloses a method of laying floor tile in the central portion of a subflooring by adhering marginal portions of adjacent tiles to each other at the overhanging-underfitting portions of such tiles. The equilibriation of moisture between the atmosphere and the subflooring is attained because of the venting paths between the subflooring and the atmosphere through the gaps existing where tiles abut. This advantageous bonding of adjacent tiles does not require any adhesion of the tile to the subflooring or any adhesive between abutting vertical walls of adjacent tiles.

Said system has been generally satisfactory and represents a significant commercial success. However, in some instances difficulties have been encountered by reason of the propensity of floor tiles to undergo dimensional changes when subjected to fluctuating humidity and fluctuating temperature. Under adverse conditions, some de-adhesion has occurred, thus stimulating efforts to minimize the possibility of de-adhesion.

Figure 1:
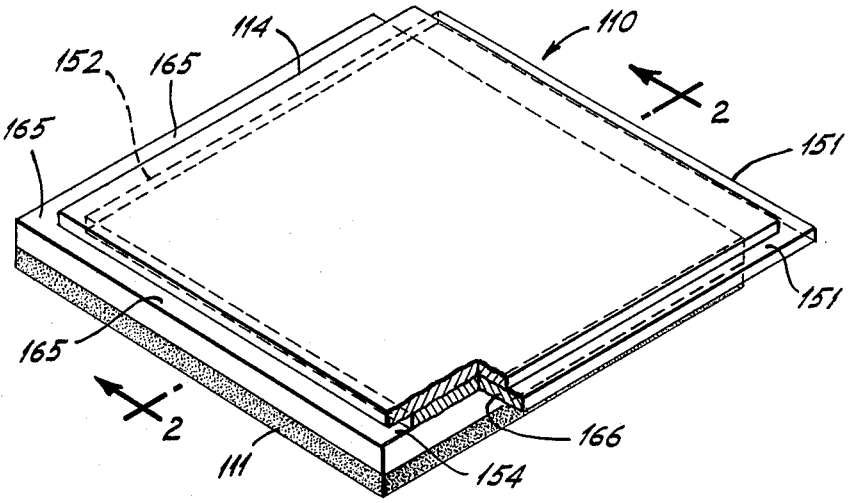
FIG. 1 is a perspective view of an underfitting floor tile having overhanging-underfitting boundary portions.

As shown in FIG. 1, a floor tile 110 comprises a resilient layer 111 and a top attrition resistent layer 114. A wafer board layer comprising two strata 149 and 152 makes feasible tongue and groove fittings between adjacent tiles. The depth of groove 154 is less than the magnitude of the overhang 151 of an adjacent tile.

Only a tip of overhang 151 is inserted as a tongue 153 into groove 154, leaving a wide potential bonding zone 166 on the undersurface of overhang 151. Similarly underfitting boundary zone includes a potential gripping zone 165 which could be adhesively secured to a potential bonding zone 166 of an overhanging portion of an adjacent tile.

The use of a tongue 153 and groove 154, though desirable, is optional, inasmuch as the adhesion bonding between a bonding zone 166 and gripping zone 165 of adjacent tiles can glue the tiles together. A tile lacking the tongue and groove but having a potential gripping zone and a potential bonding zone can be comprehended as a modification of the tile shown in FIG. 2.

It is sometimes desirable to employ a film 156 of pressure sensitive adhesive along at least a portion of the three walls (top wall 161, rear wall 152, and bottom wall 163) of groove 154. Thus the tile can be shipped from the factory with the pressure sensitive adhesive at appropriate locations (e.g. top wall 161 and bottom wall 163 of groove 154) but without any protective paper thereover. It is only when the floor is being laid and tongue 153 is inserted in the groove 154 that the pressure sensitive adhesive encounters a surface to which it can bond. The remote location of the pressure sensitive adhesive permits convenient handling of the tiles prior to the laying of the floor. Using paper protection for a film or pressure sensitive adhesive, such adhesive can be on the gripping zone 165 for potential bonding with a bonding zone 166 of an adjacent tile, but no drawing of this comprehensible modification is necessary.

It is sometimes appropriate to employ a brushed on adhesive which can be applied to a potential gripping zone 165 on an underfitting boundary portion just prior to the positioning of a corresponding portion 166 of the overhanging boundary portion of an adjacent tile whereby a relatively wide band of adhesive can be effective in securing adjacent tiles together.

Figure 2:
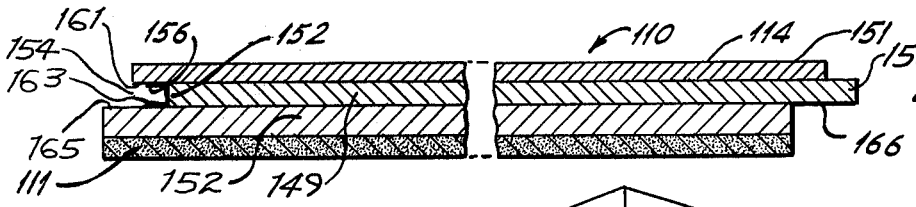
FIG. 2 is a cross-sectional view of a portion of the tile of FIG. 1.
Figure 3:
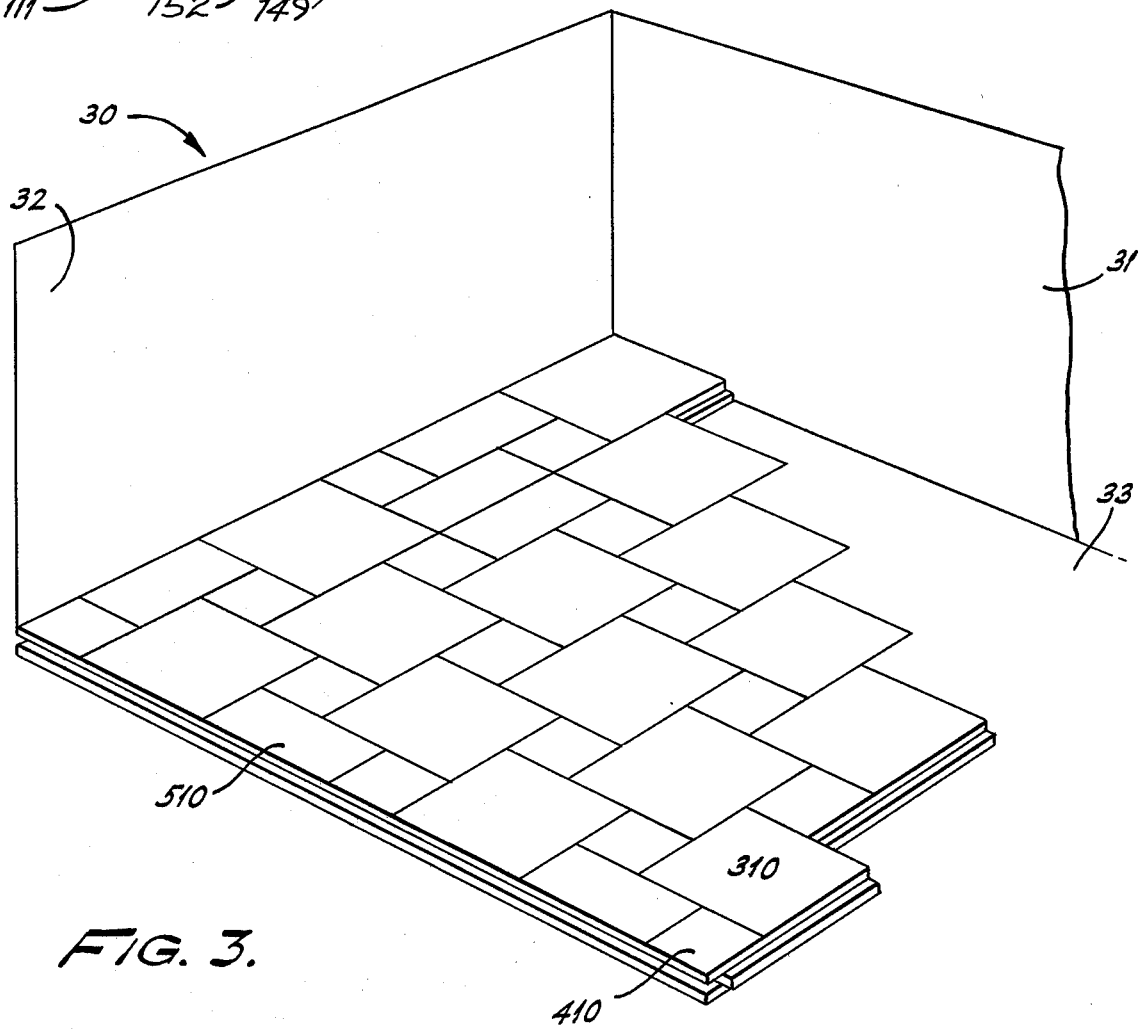
FIG. 3 is a perspective view of a room in which the tiles of a central portion are held together by the adhesion in the overlapping-underlying portions of the boundary portions of the adjacent tiles.

As shown in FIG. 3, a room 30 has walls 31 and 32, and a subflooring 33. A plurality of larger floor tiles 310 and smaller tiles 410, and intermediate sized tiles 510, corresponding generally to the floor tile described in connection with FIGS. 1 and 2, are laid so that the tiles are held together predominantly by reason of the adhesion at the overhanging-underfitting zone. The overlapping lip of a tile is pressed against boundary portions of an adjacent tile. The boundary portion is desirably coated with an adhesive to make such boundary portion a part of a path of adhesive. In this manner each tile is adhered to a plurality of adjacent tiles.

At the periphery of the room, where tile trimming is ordinarily required, the bottommost layer of the tile can be adhered to the subflooring, thus providing at least a partial anchoring of the entire floor system to subflooring while still permitting most of the floor tiles to retain a controlled amount of independent vertical resiliency of the type not readily achieved when each floor tile is adhered to the subflooring.

Figure 4:
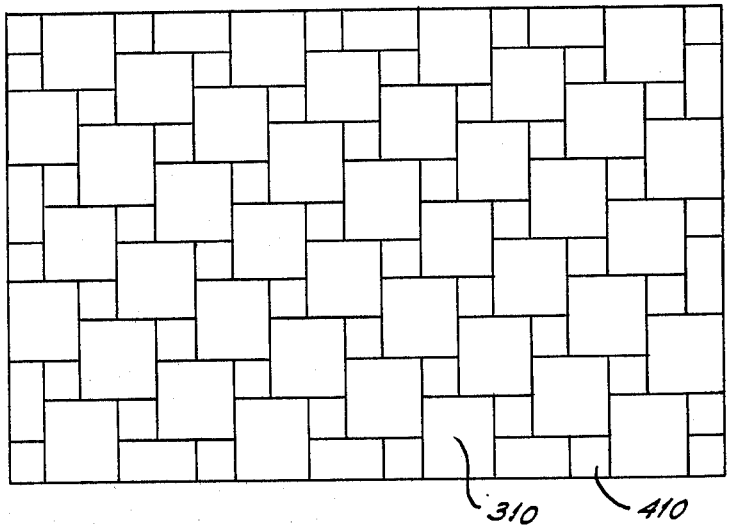
FIG. 4 is a schematic top view of a two-way staggering of small and large tiles.

As shown in FIG. 4, a plurality of sizes of floor tiles must be employed. The length and width of a larger tile 310 are each essentially twice that of the smaller tile 410 so that the area of the attrition resistent top layer of the larger tile is four times that of the smaller tile. It should be noted that the marginal or boundary portions of the smaller tile have the same width as the boundary portions of the larger tile so that there can be interchangeability of interfitting.

Figure 5:
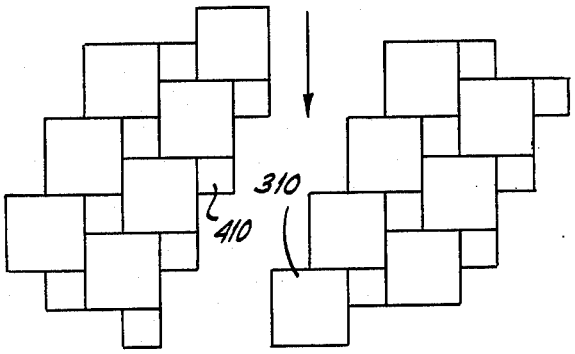
FIGS. 5 and 6 are exploded views of the tile arrangements of FIG. 4 showing absence of straight line glue lines across layout.
Figure 6:
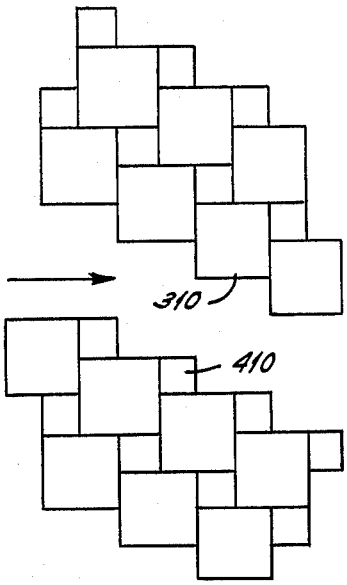

Particular attention is directed to FIGS. 4, 5, and 6 in which an assortment of approximately an equal number of small tiles and large tiles are adhered to each other so that the boundary path across the zone is staggered in each of the two rectangular directions. Such double staggering of the paths of the adhesive bonding enhances the engineering strength of the flooring so that there is less propensity for any de-adhesion when subjected to the forces of contraction and expansion attributable to fluctuations of humidity and/or temperature. Moreover, settling of foundations and/or other modifications of the structure sometimes impose strains upon a flooring tending to urge the flooring to the bulging or opening along a gap. The double staggering of the tile arrangement of FIGS. 4, 5, and 6 significantly decreases the possibility of such strains leading to an actual de-adhesion of the adjacent tiles and helps maintain the bonded together structure of the pattern of floor tiles. At the periphery of the room, intermediate sized tiles 510 may be used, but two small tiles can be substituted for intermediate sized tiles.

Various aesthetically attractive patterns are feasible for the double staggering path of adhesion across the central portion of a flooring using the combination of larger tiles and smaller tiles of the present invention.

Various modifications of the invention are possible without departing from the scope of the appended claims.

The invention claimed is:

1. A method of applying floor tiles to a subflooring for an area which includes the steps of:

preparing a set of smaller rectangular floor tiles having a predetermined length and a predetermined width, each tile having overhanging-underfitting relationship of straight line boundary portions which in the unadhered conditions permit two adjacent tiles to be slideably adjustable with respect to each other;

preparing a set of larger rectangular floor tiles having a predetermined length substantially twice the length of said smaller tile and having a predetermined width substantially twice the width of said smaller tile, each tile having overhanging-underfitting relationship of straight line boundary portions which in the unadhered condition permits two adjacent tiles to be slideably adjustable with respect to each other;

applying floor tiles to a central portion of a subflooring, said tiles being adhered to each other only at the overhanging-underfitting zones, while retaining vent paths for the diffusion of moisture to permit the moisture content of the subflooring and the moisture content of the atmosphere to equilibriate readily in such central area because of not using conventional adhesive relationship of the floor tiles and subflooring throughout such central area, a gas permeation zone being maintained between the vertical walls of adjacent tiles, there being no adhesion between said vertical walls;

staggering the distribution of a substantially equal number of said smaller tiles and said larger tiles in said central area whereby any path of adhesion across the central portion in either of two rectangular directions has numerous offsets and staggers involving no continuous line longer than about one and one-half lengths of a larger tile, each larger tile on each of its four sides having the adhesive overhanging-underfitting bonding with a portion of at least one other larger tile and with at least a portion of a smaller tile, said staggering of the adhesion to the subflooring imparting greater resistance to buckling, separation of adjacent tiles and related long term malfunction stimulated by fluctuations of humidity and temperature than attained for the similar adhesion of the overlapping-underlying boundary portions of rectangular tiles of substantially uniform size when laid without adhesion to the subflooring.

* * * * *